US005096722A

United States Patent [19]

Bair

[11] Patent Number: 5,096,722

[45] Date of Patent: Mar. 17, 1992

[54] FOOD PACKAGE FOR MICROWAVE COOKING CONTAINING A GREASE-ABSORBING PAD

[75] Inventor: Thomas I. Bair, Wilmington, Del.

[73] Assignee: E. I. Du Pont de Nemours and Company, Wilmington, Del.

[21] Appl. No.: 655,837

[22] Filed: Feb. 15, 1991

[51] Int. Cl.[5] ..... B65D 85/00

[52] U.S. Cl. ..... 426/107; 426/124; 426/129; 426/234; 426/396; 428/36.1

[58] Field of Search ..... 426/124, 129, 396, 234, 426/107; 428/36.1

[56] References Cited

U.S. PATENT DOCUMENTS

| | | | |
|---|---|---|---|
| 4,027,346 | 6/1977 | Wada et al. | 428/375 |
| 4,475,911 | 10/1984 | Gellert | 604/367 |
| 4,720,410 | 1/1988 | Lundquist et al. | 428/136 |
| 4,770,920 | 9/1988 | Larsonneur | 426/124 |
| 4,786,513 | 11/1988 | Monforton et al. | 426/107 |
| 4,851,273 | 7/1989 | Brown | 428/76 |
| 4,865,854 | 9/1989 | Larson | 426/107 |
| 4,865,855 | 9/1989 | Hansen et al. | 426/124 |
| 4,873,101 | 10/1989 | Larson et al. | 426/113 |
| 4,892,782 | 1/1990 | Fisher et al. | 428/240 |
| 4,935,275 | 6/1990 | Pawloawski et al. | 426/124 |

*Primary Examiner*—Donald E. Czaja
*Assistant Examiner*—Jean L. Aberle

[57] ABSTRACT

An improved package for microwave cooking of food has a grease-absorbing pad that has a porous spunbonded polyester outer fabric bonded to a needle-punched nonwoven polyester staple-fiber core layer. The pad provides efficient absorption and retention of liquid fat and grease generated during microwave cooking.

4 Claims, 2 Drawing Sheets

FOOD PACKAGE FOR MICROWAVE COOKING CONTAINING A GREASE-ABSORBING PAD

BACKGROUND OF THE INVENTION

1. Field of the Invention

This invention relates to a food package in which food resting on a grease-absorbing pad can be cooked directly in the package by microwave energy. More particularly, the invention concerns an improvement in such a package wherein the grease-absorbing pad is a composite nonwoven fabric comprising a porous spunbonded polyester outer fabric attached to a needle-punched nonwoven polyester staple-fiber web.

2. Description of the Prior Art

Packages are known for use in microwave cooking of foods that generate large amounts of liquid grease, fat and oil. In such packages, the food usually rests on a grease-absorbing pad and is sealed in a microwave-transparent film enclosure.

Larson, U.S. Pat. No. 4,865,854, and Larson et al. U.S. Pat. No. 4,873,101, disclose such food packages for microwave cooking of bacon, sausages, and other such fatty foods. The food rests on a pad of melt-blown microfibers of polypropylene, poly(4-methylpentene-1), polyethylene, polyester, or a mixtures thereof, preferably a 50/50 mixture of polypropylene and polymethylpentene. The pad has a network of compacted high-density regions and low-density pillowed regions. Grease that is liquefied and released from the food during cooking is absorbed by the pad and amounts to 4 to 12 times the weight of the pad. The food and pad are contained in a vapor-tight enclosure that is transparent to microwaves and visible light.

Monforten et al, U.S. Pat. No. 4,786,513, and Lunquist et al, U.S. Pat. No. 4,720,410, each disclose a food package for microwave cooking of stacked slices of bacon. Sheets interleaved between successive strips of bacon direct the liquid grease that forms during cooking to an absorbent blotter. The blotter consists of a perforated thermoplastic film atop a grease-absorbing layer of molded pulp, paper or the like.

Food packages intended for crisping or browning food during microwave cooking are disclosed by Fisher et al, U.S. Pat. No. 4,892,782. The packages include fibers or substrates that are coated or imbibed with susceptor materials and require the use of much higher temperatures during cooking to crisp or brown the food.

Brown, U.S. Pat. No. 4,851,273, though not concerned with food packages for microwave cooking, discloses a wide range of pads for use in absorbing residual oils and grease that may remain on fried food immediately after the food is removed from the frying oil. The pad comprises an outer oil-permeable protective layer, which preferably is a woven polypropylene fabric, and an inner layer of absorbent material, which preferably is a nonwoven, fibrous polypropylene product. Brown discloses broad ranges of materials and characteristics for the pads, but specifically exemplifies only a pad with the preferred woven polypropylene outer fabric and the preferred nonwoven polypropylene absorbent material.

Although known food packages for microwave cooking have been used with some success, further improvements are needed to enhance their utility. For example, the short, weak, polypropylene microfibers of some absorbing pads in commercial food packages for microwave cooking often stick to the surface of the food and are pulled out of the pad when the cooked food is separated from the pad. Also, temperatures during microwave cooking of meats often are high enough (>150° C.) to cause softening or even melting of pad fibers. Pads made of fibers of ordinary textile decitex usually require the absence of additives or finishes that are conventionally used in the manufacture of the fibers. In this regard, one may use only substances approved by the Federal Food and Drug Administration for contact with food, such as the emulsifiers and surface active agents set forth in 21 CFR Chapter 1 (4-1-88 Edition) Section 178.3400.

It is an object of this invention to provide an improved microwavable food package wherein the above-mentioned shortcomings of known packages may be eliminated or greatly reduced.

SUMMARY OF THE INVENTION

The present invention provides an improvement in a known package for microwave cooking of food. The known package contains food resting on a grease-absorbing pad and has a microwave-transparent film portion through which microwave energy can pass to cook the food. In accordance with the improvement of the present invention the pad consists essentially of a needle-punched core layer that weighs 125 to 250 g/m$^2$ and consists essentially of polyester staple fibers of 1 to 6 dtex and 2.5 to 10 cm length, and a porous outer layer, intended for being in contact with the food, that weighs 15 to 25 g/m$^2$, consists essentially of spunbonded continuous polyester filaments of 1 to 6 dtex, and is bonded to the needle-punched staple fiber core layer, and the pad has a total thickness of 2 to 6 millimeters, preferably 2.5 to 3 mm, and an oil absorption capacity of at least 0.2 g/cm$^2$, preferably at least 0.25 g/cm$^2$.

In one embodiment of the invention, the outer layer and the core of the pad are thermally sealed at their edges. In another embodiment, the needle-punched core layer is bounded on its upper surface by a first porous spunbonded polyester fabric and on its lower surface by a second porous spunbonded polyester fabric, the edges of the upper and lower fabrics extending beyond the edges of the needle-punched core layer and the extending edges of the two porous fabrics being heat sealed to each other to completely enclose the needle-punched core layer. In still another embodiment having an upper and a lower spunbonded outer layer, the outer layers and the core layer are heat sealed together at their edges.

In further preferred embodiments of the invention, the core layer of the grease-absorbing pad of the food package of the invention has about 15 to 45 needle punches per cm$^2$, most preferably 35 to 40/cm$^2$; outer layers are point-bonded with a pattern of discrete small areas covering 25 to 45%, most preferably 30 to 40%, of the total outer surface area of the pad; and the absorption capacity of the pad for oil amounts to at least 10 times the total weight of the pad.

BRIEF DESCRIPTION OF THE DRAWINGS

The invention will be better understood by referring to the attached drawings wherein.

Figure 1:
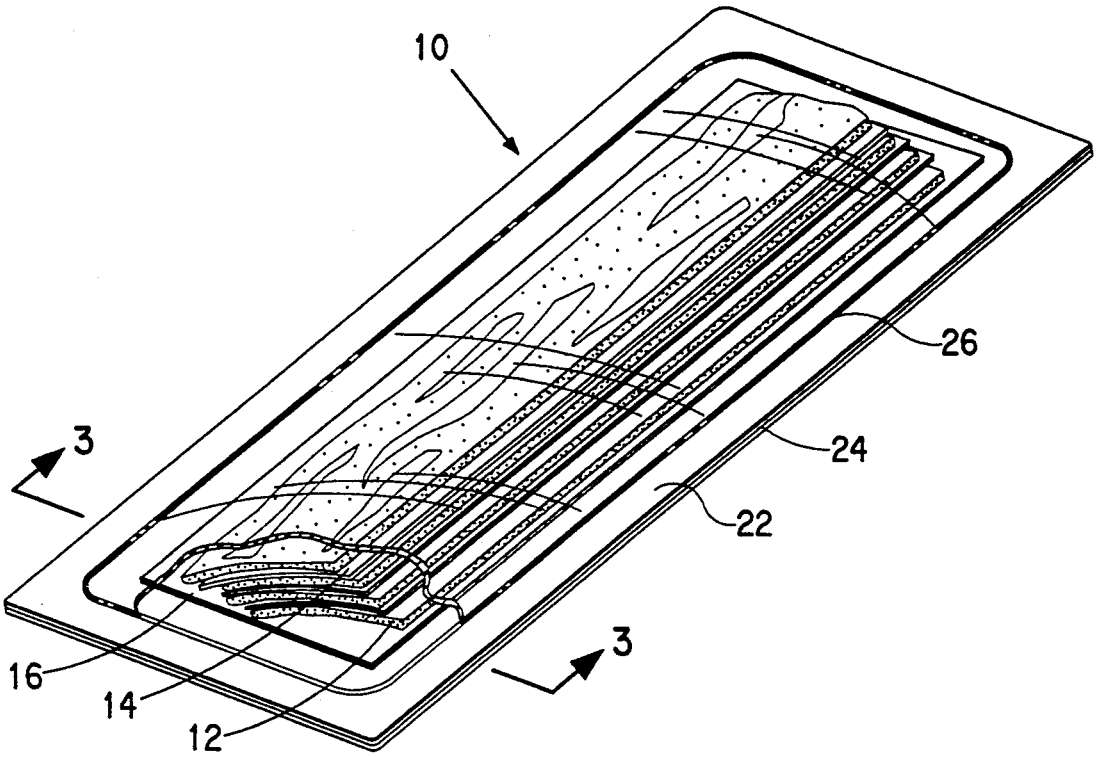
FIG. 1 (PRIOR ART)
FIG. 1 is a perspective view with a partial cut-away of a prior-art microwavable food package 10, in which a stack of bacon slices 12 in shingled arrangement with separating sheets 14 between each pair of slices, is supported on "absorbent blotter" (i.e., grease-absorbing pad) 16 which comprises perforated layer 18 atop absorbent layer 20, the stack of bacon slices and the absorbent blotter being contained between top wrap film 22 and bottom wrap film 24, which films are sealed together at seal 26.

Each of pads 30, 40 and 50 are intended as replacements for prior-art absorbent grease-absorbing blotter 16 of FIG. 1 to form an improved microwavable food package of the invention.

DETAILED DESCRIPTION OF PREFERRED EMBODIMENTS

The following descriptions of preferred embodiments are intended to illustrate the invention, but not limit its scope. The scope of the invention is defined by the appended claims.

Figure 2:
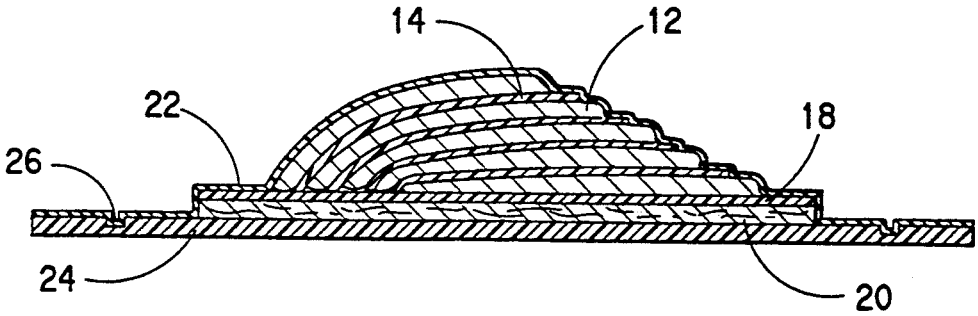
FIG. 2 (PRIOR ART)
FIG. 2 is a detailed vertical cross-section at 3—3 of FIG. 1 of the prior-art food package 10.

The present invention is an improvement in a known food package for microwave cooking. In the known package, food resting on a grease-absorbing pad is enclosed in a wrapping that has a film portion through which microwave energy can pass to cook the food. An example of such a prior-art food package for microwave cooking is shown in attached FIGS. 1 and 2 and in Monforton et al, U.S. Pat. No. 4,786,513, the disclosure of which is incorporated herein by reference.

In accordance with the improvement of the present invention, the grease-absorbing pad consists essentially of a core layer of needle-punched staple polyester fibers and a porous outer layer of spunbonded continuous polyester filaments. The polyester fibers and filaments usually have a melting temperature of at least 450° F. (222° C.). The high melting temperature of the polyester fibers, compared to that of the polyolefin fibers of the absorbers of commercially used food packages for microwave cooking, permits higher cooking temperatures without the food becoming stuck to the absorber pad.

Usually, the core layer of the grease-absorbing pad is formed from a loose web of staple fibers of polyethylene terephthalate. The polyester fibers generally have a dtex in the range of 1 to 6, preferably 1.25 to 1.75, and a length in the range of 2.5 to 10 cm, preferably 3 to 4 cm. A mixture of polyester staple fibers, within these decitex and length ranges, can be used for the core layer. Any finishes on the fibers are consistent with the requirements of Federal Food and Drug Administration regulations. Polyester staple fibers suitable for use in the present invention are available commercially; for example, Type-10B Dacron® polyester fiber sold by E. I. du Pont de Nemours & Co., Wilmington, Del.

The loose staple polyester fiber web, which usually has a weight in the range of 125 to 250 g/m$^2$, can be prepared by conventional carding, air-laydown, Rando-Webber or like techniques. The loose web is consolidated by needle-punching to form an entangled web. Needle-punch densities are usually in the range of about 15 to 45 per cm$^2$, preferably 35 to 40/cm$^2$.

The grease-absorbing pad for use in the present invention has a porous outer layer which is a spunbonded nonwoven fabric of continuous polyester filaments. The filaments usually have an average decitex in the range of 1 to 6. The weight of the spunbonded porous fabric is usually in the range of 15 to 25 g/m$^2$. Preferably, the nonwoven outer fabric contains a minor fraction of polyester filaments that have a melt temperature that is somewhat lower (e.g., 10°-25° C.) than the melt temperature of the other polyester filaments in the layer and of the polyester staple fibers in the consolidated web. Such a preferred outer layer fabric is Style 2250 Reemay® spunbonded polyester, which is available commercially from Reemay, Inc., of Old Hickory, Tenn. The Reemay® fabric is porous and has a Frazier Permeability of about 1100 ft$^3$/min.

In accordance with the invention, the needle-punched core layer of polyester staple fibers can be bonded to the porous outer fabric of spunbonded polyester filaments by any one of several known techniques. Conventional hot calendering is preferred, particularly with a patterned roll that provides a visible pattern of "point bonds" on the surface of the bonded article. Each point bond is a small discrete bonded area, usually no larger than about 10 mm$^2$. Generally, point bonds in accordance with the invention cover about 25 to 45% of the outer layer surface, impart cohesion and strength to the structure, and reduce the porosity of the outer fabric very little.

Figure 3:
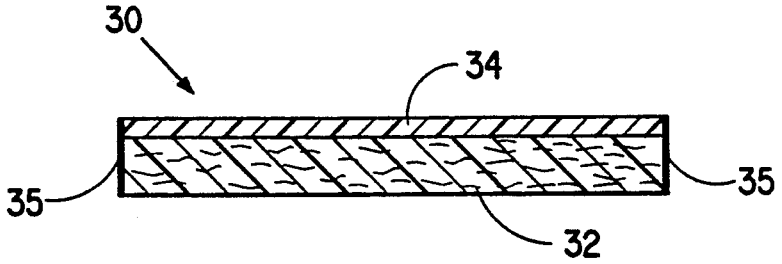
FIG. 3 is a grease-absorbing pad 30, intended for use in a improved microwavable food package of the invention, having a needle-punched core layer 32 of polyester staple fibers bonded to a porous spunbonded polyester nonwoven upper layer 34 and the edges of both layers being heat sealed at seal 35.
Figure 4:
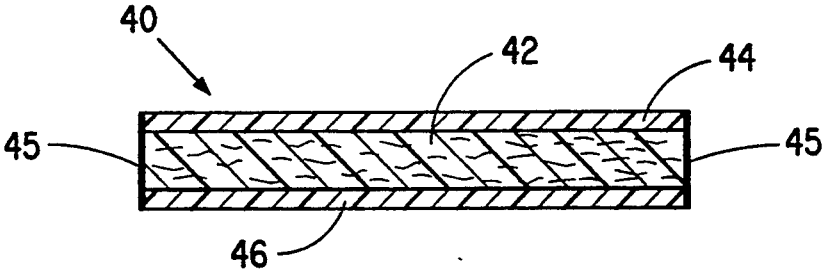
FIG. 4 is a cross-section of another pad 40 intended for use in a food package of the invention, having an upper porous spunbonded layer 44 and a lower porous spunbonded layer 46 thermally bonded to needle-punched polyester staple fiber core layer 42 the edges of all three layers being heat-sealed to form seal 45 which thereby encloses the needle-punched core layer.
Figure 5:
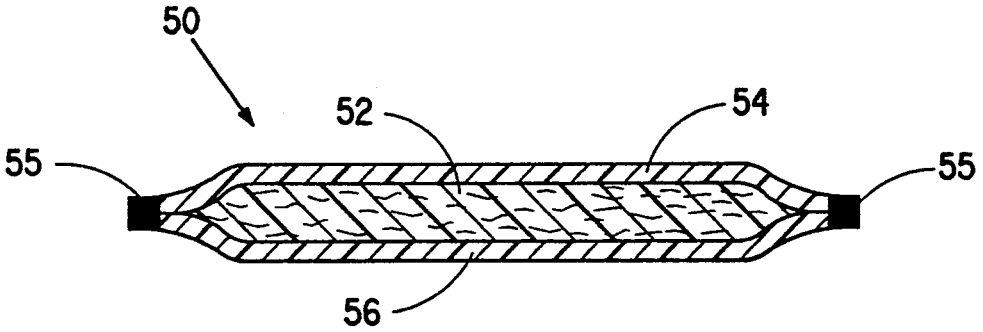
FIG. 5 is a cross-section of still another a pad 50 for use in the present invention, the pad having upper and lower layers 54 and 56 respectively extending beyond the edges of core layer 52, the edges of the upper and lower layers 54 and 56 being heat sealed together at seal 55 to completely enclose core layer 52.

When the pad is formed with only one outer layer of porous spunbonded polyester continuous filament fabric bonded to the core layer of needle-punched polyester staple fibers, it is preferred to heat seal the edges of the core and the upper layer together, as schematically depicted in attached FIG. 3. Preferably, both faces of the core layer are covered with porous spunbonded fabrics. When both faces of the core are so covered, the edges of the porous fabrics and the fiber core can be similarly sealed, as shown in FIG. 4. Alternatively, the upper and lower fabrics can extend beyond the core of the pad and be sealed together to completely surround the core with the outer fabrics, as shown in FIG. 5. The sealing may be done by a variety of conventional means. For example, a sonic welder, a hot wire or a hot knife may be used. It is preferred to seal the pad layers while simultaneously cutting the pad to size.

The thusly formed grease-absorbing pads generally have a total thickness in the range of 2 to 6 mm, preferably 2.5 to 3 mm. With these thicknesses and layer weights described above, the pads efficiently absorb and retain hot grease and oils released from food during microwave cooking. The pads are also sufficiently supple to permit the food package to be folded in half, as is often done with commercial packages of bacon.

The porous outer layers of spunbonded polyester filaments of the grease-absorbing pad perform several functions. The outer layers provide a surface on which the food rests while being displayed or cooked. The outer layers also prevent short weak fibers from being pulled out of the core layer when the food is removed from the package after cooking. Further, the outer layers provide strength and dimensional stability to the composite pad, while permitting fluids generated during cooking to pass readily through the outer layer to be absorbed and retained in the staple fiber core.

The grease-absorbing pads for use in food packages made in accordance with the invention can readily absorb liquid cooking grease and oils amounting to many times the dry weight of the pad. Usually, the pad has an oil absorption capacity (measured as described hereinafter) of at least 0.2 gram per square centimeter of pad, preferably at least 0.25 g/cm$^2$. Often the amount of oil absorbed can be ten or more times the dry weight of the pad.

The examples below further illustrate preferred embodiments of the invention. Various characteristics of the grease-absorbing pads and their performance versus commercially used known materials are reported. Test methods for the measurement of the characteristics are set forth in the following paragraphs.

Unit weight of the various starting layers of spunbonded fabrics and staple fiber webs are measured in accordance with ASTM Method D 3776-79 and is reported grams per square meter. Fabric thickness is measured with a conventional fabric thickness gauge having a right-cylindrical foot of 2-inch (5.08-cm) diameter bearing a load of 51 grams. Grab tensile strength is measured with an Instron Tester in accordance with ASTM Method D 117-80 an is reported in pounds per inch (Newtons/cm) of sample width. Porosity of the outer spunbonded fabric layers is determined with a Fabric Permeability Machine sold by Frazier Precision Instrument Co., Gaithersburg, Md., which measures the flow of air per minute across a square foot of fabric under a pressure differential of 0.5 inches of water.

Absorption capacity of the grease-absorbing pad is measured by placing a sample pad measuring 4-inches long by 4-inches wide (10.16-cm by 10.16-cm) in a deep dish filled with sufficient vegetable cooking oil (Wesson Oil) to completely cover the sample for at least one minute, removing the sample from the oil and allowing the sample to drain until oil stops dripping from the sample (usually in less than two minutes) and then determining the weight gain of the sample. Absorption capacity is recorded as weight gain in grams per square centimeter or as a ratio of weight gain to original weight of the pad.

EXAMPLES

The making of two grease-absorbing pads of improved food packages in accordance with the invention is described in Examples 1 and 2. The oil-absorbing capacity of the pads of the invention is shown to be greater than that of typical pads from a conventional commercial food package for microwave cooking of bacon. The advantage of improved microwave food packages of the invention is further demonstrated in Example 3, wherein the microwave cooking of bacon strips in a package containing an improved grease-absorbing pad in accordance with the invention is compared to such cooking of bacon in a package containing a pad from a commercial microwave food package. In contrast to the commercial pad, the cooked bacon did not stick to the pad of the invention and the pad of the invention absorbed more liquefied grease and fat.

EXAMPLES 1 AND 2

Two pads were prepared in accordance with the invention. The starting material for the outer porous fabric of each pad was a 0.5-oz/yd$^2$ (17-g/m$^2$) spunbonded, continuous polyester filament, nonwoven fabric (Reemay ® Style 2250). The core layer of each pad was formed from a needle-punched carded batt of 1.5-denier (1.6-dtex), 1.5-inch-long (3.8-cm) polyethylene terephthalate staple fibers (Type-10B Dacron ® polyester fiber, sold by E. I. du Pont de Nemours and Company). The porous outer fabric was thermally bonded to the staple fiber core layer by assembling the layers face-to-face and passing the assembled layers through the nip formed by two coacting, internally heated, metal rolls. The surface of one of the rolls was smooth. The surface of the other roll had an engraved pattern of about 150 square-ended nubs projecting from each square inch of surface (23.3 nubs/cm$^2$). Each side of the square cross-section of each nub measured about 1.5-mm.

The grease-absorbing pad of Example 1 was prepared as follows. A carded batt, as described in the preceding paragraph and weighing about 6.2 oz/yd$^2$ (210 g/m$^2$) was consolidated by needling on conventional equipment with about 250 needle-punches per square inch (38.6/cm$^2$). The needled batt was placed atop a porous 0.5-oz/yd$^2$ (17-g/m$^2$) spunbonded, polyester fabric (also as described in the preceding paragraph). The porous fabric had been point-bonded at a temperature of 190° C. and under a load of 100 pounds per inch of nip width (18 kg/cm) with a pattern of point bonds that resulted in a visible pattern that covered about 35% of the surface area of the porous fabric. The two-layer assembly of porous fabric and needled batt were then passed through the point-bonding calender with the temperature at 155° C. under a load of 60 lb/in (10.7 kg/cm) with the needled web in contact with the patterned roll. The two layers were thereby combined into a lightly bonded pad of the invention which weighed 6.7 oz/yd$^2$ (227 g/m$^2$), was 0.115-inch (2.9-mm) thick and had a grab strength of about 14 lb/in (24.5 Newtons/cm).

A 4 by 4 inch (10.2 by 10.2 cm) oil-absorption sample of the pad of Example 1, weighing 2.3 grams, was placed in vegetable oil for five minutes, removed from the oil and then held vertically for several minutes, after which time oil had stopped draining from the sample. A total was 24.8 grams of oil was absorbed by the sample, or about 0.25 gram/cm$^2$. The absorbed oil weighed 10.8 times the dry weight of the pad.

The grease-absorbing pad of Example 2 was prepared as follows. A carded batt of polyester staple fibers was consolidated by needling with 125 punches/in$^2$ (19.4/cm$^2$). The consolidated batt was placed atop a first Reemay ® Type-2250 spunbonded, continuous polyester filament nonwoven fabric. A second identical Reemay ® nonwoven polyester fabric was then placed atop the needled web. The three-layer assembly was passed through the nip of the calender rolls (as described in the preceding paragraph) at a temperature of 170° C. under a load of about 100 lb/in (18 kg/cm) to bond the outer layers to the inner web. The thusly prepared lightly bonded pad weighed about 6.9 oz/yd$^2$ (234 g/m$^2$), was 0.124-inch (3.1-mm) thick and had a grab strength of about 26 lb/in (46 N/cm).

An oil-absorption test sample of the bonded pad of Example 2, weighing 2.4 grams, was placed in vegetable oil for two minutes, removed from the oil and then allowed to drain for about 10 minutes. The total amount of oil absorbed was 35.2 grams. This absorption amounted to about 0.34 grams/cm$^2$ or almost 15 times the dry weight of the pad.

For comparison purposes, two commercial polypropylene grease-absorbing pad were removed from two different microwave cooking packages of bacon (sold by Geo. Hormel Co. of 501 16th Ave. N.E., Austin Minn. 55912). The first polypropylene pad sample, designated comparison Sample A, had a thickness of 0.048 inch (1.2 mm) and a density of 0.17 g/cm$^3$ and absorbed 0.09 g/cm$^2$ of oil in an oil absorption test (an absorption equivalent to 4.4 times the dry weight of the pad). The second commercial pad sample, designated comparison Sample B, had a thickness of 0.060 inch (1.5 mm), a density of 0.15 g/cm$^3$ and an oil-absorption capacity of 0.20 g/cm$^2$ (equivalent to 9.1 times the dry weight of the pad).

The results reported above indicate that, per unit weight, the pads of Examples 1 and 2 are superior in oil absorption capacity to the tested commercially used comparison pads.

EXAMPLE 3

This example compares the performance of food package containing an grease-absorbing pad in accordance with the invention with that of polypropylene pad from a commercial microwave cooking food package. The superiority of the pad of the invention is clearly demonstrated.

A grease-absorbing pad sample of Example 1, measuring 5 by 7½-inches (12.7 by 19.1 cm) and weighing 5.8 grams, and 128.6 grams of bacon were placed between two sheets of Mylar® polyester film (sold by E. I. du Pont de Nemours & Co.). The edges of the sheets were sealed together to form a closed pouch. The pouch and its contents were placed in a microwave oven. The bacon was then microwave cooked for 4 minutes. Then the pouch and bacon were removed from the oven and allowed to rest undisturbed for about one minute. The end of the pouch was opened, the pouch was tipped to about a 45 degree angle for about 30 seconds and free liquid grease allowed to drain. The drained liquid weighed 4 grams. The cooked, slightly-crisp bacon was lightly wetted with grease. The bacon, which was then removed from the pouch weighed 23.5 grams (18% of uncooked weight). The pad, when removed from the pouch, weighed 56.6 grams. Thus, 52.8 grams of grease were absorbed. This absorption was equivalent to 0.22 g/cm$^2$ or about 9.1 times the dry weight of the pad.

A 5.4-gram pad sample, similar to Comparison Sample B but being about 50% thicker, was packaged with 122.1 grams of bacon, as described in the preceding paragraph. After cooking and handling as above, the cooked bacon had fused to the pad and was difficult to remove. The bacon was excessively wetted with grease and weighed 29.5 grams (24% of uncooked weight). The excess free grease weighed 5.1 grams, and the pad weighed 50.7 grams. Thus, 45.3 grams of grease were absorbed, or approximately 0.19 g/cm$^2$ or about 8.4 times the dry weight of the pad.

I claim:

1. In a microwavable food package for containing food resting on a grease-absorbing pad, the package having a transparent film portion through which microwave energy can pass to cook the food, the improvement comprising the pad consisting essentially of a needle-punched core layer weighing in the range of 125 to 250 g/m$^2$ and consisting essentially of polyester staple fibers of 1 to 6 dtex and 2.5 to 10 cm length, the number of needle punches in the core being in the range of 15 to 45 per cm$^2$ and a porous outer layer, intended for being in contact with the food, weighing in the range of 15 to 25 g/m$^2$, consisting essentially of spunbonded continuous polyester filaments of 1 to 6 dtex, and being point-bonded to the needle-punched core layer, the point-bonded area amounting to 25 to 45% of the total outer surface area of the pad, the polyester fibers and filaments have a melting temperature of at least 450° F., and the pad having a total thickness in the range of 2 to 6 millimeters and an oil absorption capacity of at least 0.2 gram of oil per square centimeter of pad area.

2. A food package of claim 1 wherein the outer layer and the core layer are thermally sealed at their edges.

3. A food package of claim 1 wherein the needle-punched core layer is bounded on its upper surface by a first sheet of porous spunbonded polyester fabric and on its lower surface by a second porous spunbonded polyester fabric, the edges of the upper and lower porous fabrics extending beyond the edges of the needle-punched core layer and the extending edges of the two porous fabrics being heat sealed to each other to completely enclose the needle-punched core layer.

4. A food package in accordance with claim 1, 2 or 3 wherein the number of needle punches in the core layer is in the range of 35 to 40 per cm$^2$ and the absorption capacity of the pad for oil is at least ten times the weight of the pad.

* * * * *